US009500174B2

(12) United States Patent
Holguin Pallares et al.

(10) Patent No.: US 9,500,174 B2
(45) Date of Patent: Nov. 22, 2016

(54) INTERNAL COMBUSTION ENGINE HAVING A CHANGE OF MIND (COM) STARTER SYSTEM AND A COM STARTER SYSTEM

(71) Applicant: REMY TECHNOLOGIES, L.L.C., Pendleton, IN (US)

(72) Inventors: German Holguin Pallares, Noblesville, IN (US); Andrew Dragon, Fishers, IN (US); Kirk Neet, Pendleton, IN (US)

(73) Assignee: REMY TECHNOLOGIES, L.L.C., Pendleton, IN (US)

( * ) Notice: Subject to any disclaimer, the term of this patent is extended or adjusted under 35 U.S.C. 154(b) by 281 days.

(21) Appl. No.: 14/244,397

(22) Filed: Apr. 3, 2014

(65) Prior Publication Data

US 2015/0285204 A1 Oct. 8, 2015

(51) Int. Cl.
*F02N 11/08* (2006.01)
*F02N 15/06* (2006.01)

(52) U.S. Cl.
CPC ..... *F02N 11/0851* (2013.01); *F02N 11/087* (2013.01); *F02N 15/067* (2013.01); *F02N 11/0844* (2013.01); *F02N 2011/0892* (2013.01); *F02N 2200/022* (2013.01); *F02N 2200/041* (2013.01); *F02N 2200/063* (2013.01)

(58) Field of Classification Search
CPC ..... F02N 11/0851; F02N 11/087; F02N 11/0844; F02N 15/067; F02N 2011/0892; F02N 2200/022; F02N 2200/041; F02N 2200/063
USPC ..... 123/406.11, 179.3, 179.25, 185.1, 123/185.5, 185, 6; 701/113; 320/132; 290/40 A, 40 C, 40 F
See application file for complete search history.

(56) References Cited

U.S. PATENT DOCUMENTS 4,415,812 A * 11/1983 Griffith ..... F02N 11/101 290/31
5,970,936 A * 10/1999 Cabrera ..... F02N 11/0848 123/179.3
6,363,899 B1 * 4/2002 Koelle ..... F02N 11/0848 123/179.3
6,707,169 B2 * 3/2004 Shimizu ..... F02N 11/06 290/40 A
7,218,010 B2 * 5/2007 Albertson ..... F02N 11/0855 290/38 R
8,566,007 B2 * 10/2013 Shoda ..... F02N 11/0855 123/179.3
2007/0062477 A1 * 3/2007 Shimazaki ..... F02D 41/062 123/179.16
2008/0162007 A1 * 7/2008 Ishii ..... F02N 11/0855 701/54
2009/0224557 A1 * 9/2009 Reynolds ..... F02N 11/0814 290/38 R
2010/0269630 A1 * 10/2010 Niimi ..... F02N 15/023 74/7 C
2012/0290194 A1 * 11/2012 Shoda ..... F02N 11/0855 701/104
2013/0325304 A1 * 12/2013 Kondo ..... F02D 29/02 701/113

* cited by examiner

*Primary Examiner* — Stephen K Cronin
*Assistant Examiner* — Susan E Scharpf
(74) *Attorney, Agent, or Firm* — Cantor Colburn LLP

(57) ABSTRACT

An internal combustion engine includes a ring gear, a speed sensor operatively associated with the ring gear, and a change of mind (COM) starter motor mechanically linked to the internal combustion engine. The COM starter motor includes an armature and a pinion operatively connected to the armature. A solenoid is operatively connected to the COM starter motor. The solenoid selectively moves the pinion into engagement with the ring gear. An electronic control unit (ECU) is operatively connected to the speed sensor and the solenoid. The ECU is configured and disposed to indirectly detect a rotational speed of the pinion and selectively energize the solenoid to axially shift the pinion into engagement with the ring gear when the pinion reaches a particular rotational speed relative to a rotational speed of the ring gear.

17 Claims, 5 Drawing Sheets

INTERNAL COMBUSTION ENGINE HAVING A CHANGE OF MIND (COM) STARTER SYSTEM AND A COM STARTER SYSTEM

BACKGROUND OF THE INVENTION

Exemplary embodiments pertain to the art of motor vehicles and, more particularly, to an internal combustion engine for a motor vehicle having a change of mind (COM) starter system.

Internal combustion engines generally include a starter motor. The starter motor is electrically energized to initiate operation of the internal combustion engine. A typical starter includes a starter motor that generates torque that is passed to a pinion gear and a solenoid. The solenoid shifts the pinion gear into engagement with a ring gear on the internal combustion engine. Once engaged, the starter motor rotates the pinion to spin the ring gear and initiate operation of the internal combustion engine.

In a standard starter motor a generally stationary pinion is shifted into engagement with a stationary ring gear. The pinion is shifted such that pinion teeth enter a gap between ring gear teeth for engagement. A standard starter motor is not typically, intentionally, energized to engage a rotating pinion. Such an engagement typically results in clashing gears and potential gear damage. In a change of mind (COM) starter, a pinion may be shifted into a rotating ring gear spinning within a speed band. Generally, the pinion is rotated to a particular speed prior to engagement with the rotating ring gear. Thus, a typical COM starter includes a ring gear speed sensor and a pinion speed sensor. In operation, if ignition is re-initiated while the ring gear is moving, a first coil of the solenoid initiates rotation of the pinion. When the pinion and ring gear are within a predetermined rotational range, as detected by the pinion speed sensor and ring gear speed sensor, a second coil of the solenoid shifts the pinion into the ring gear to re-establish operation of the internal combustion engine.

BRIEF DESCRIPTION OF THE INVENTION

Disclosed is an internal combustion engine including a ring gear, a speed sensor operatively associated with the ring gear, and a change of mind (COM) starter motor mechanically linked to the internal combustion engine. The COM starter motor includes an armature and a pinion operatively connected to the armature. A solenoid is operatively connected to the COM starter motor. The solenoid selectively moves the pinion into engagement with the ring gear. An electronic control unit (ECU) is operatively connected to the speed sensor and the solenoid. The ECU is configured and disposed to indirectly detect a rotational speed of the pinion and selectively energize the solenoid to axially shift the pinion into engagement with the ring gear when the pinion reaches a particular rotational speed relative to a rotational speed of the ring gear.

Also disclosed is a change of mind (COM) starter system including an armature, a pinion operatively connected to the armature, and a solenoid operatively connected to the COM starter motor. An electronic control unit (ECU) is operatively connected to the solenoid. The ECU is configured and disposed to indirectly detect a rotational speed of the pinion and selectively energize the solenoid to axially shift the pinion when the pinion reaches a particular rotational speed relative to a rotational speed of the ring gear.

Still further disclosed is a system including an armature, a pinion operatively connected to the armature, an energy source electrically coupled to the armature, and an electronic control unit (ECU) electrically coupled to the energy source. The ECU is configured and disposed to indirectly detect a rotational speed of the pinion.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
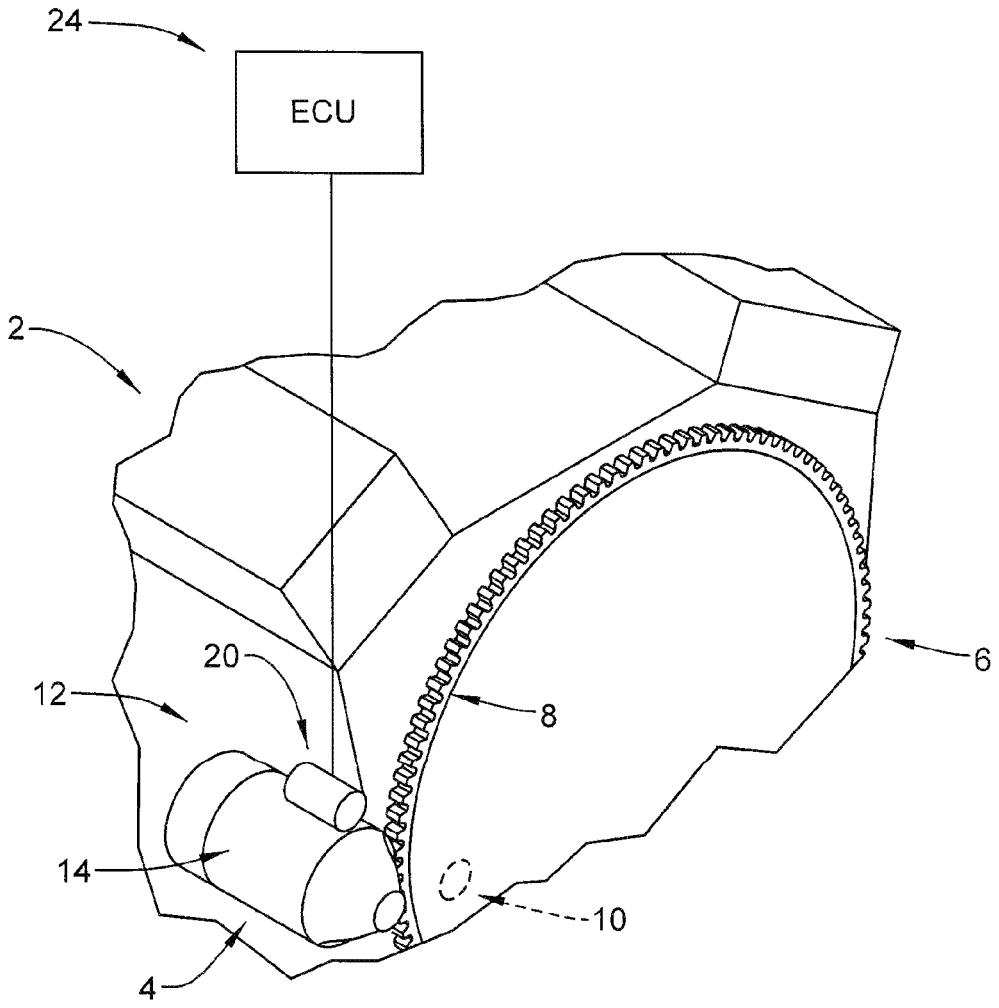
FIG. 1 depicts an internal combustion engine including a change of mind (COM) starter system, in accordance with an exemplary embodiment.

With initial reference to FIG. 1, an internal combustion engine is indicated generally at 2. Internal combustion engine 2 includes an engine block 4 that supports a flywheel 6 having a ring gear 8. Engine block 4 also supports a speed sensor 10 that detects a rotational speed of ring gear 8. A change of mind (COM) starter system 12 is mounted to engine block 4. COM starter system 12 includes a COM starter motor 14 having a solenoid 20 and an electronic control unit (ECU) 24. As will be detailed more fully below, COM starter system 12 selectively activates a COM starter motor 14 to re-initiate operation of internal combustion engine 2. At this point, it should be understood that the phrase "change of mind" describes a situation in which power has been interrupted to an ignition system (not shown) of internal combustion engine 2. For example, a driver may have activated a braking system (also not shown). Prior to reaching a stop, and while flywheel 6 is still rotating, the driver changes his mind about stopping. At such a time, COM starter system 12 activates COM starter motor 14 to re-initiate operation of internal combustion engine 2.

Figure 2:
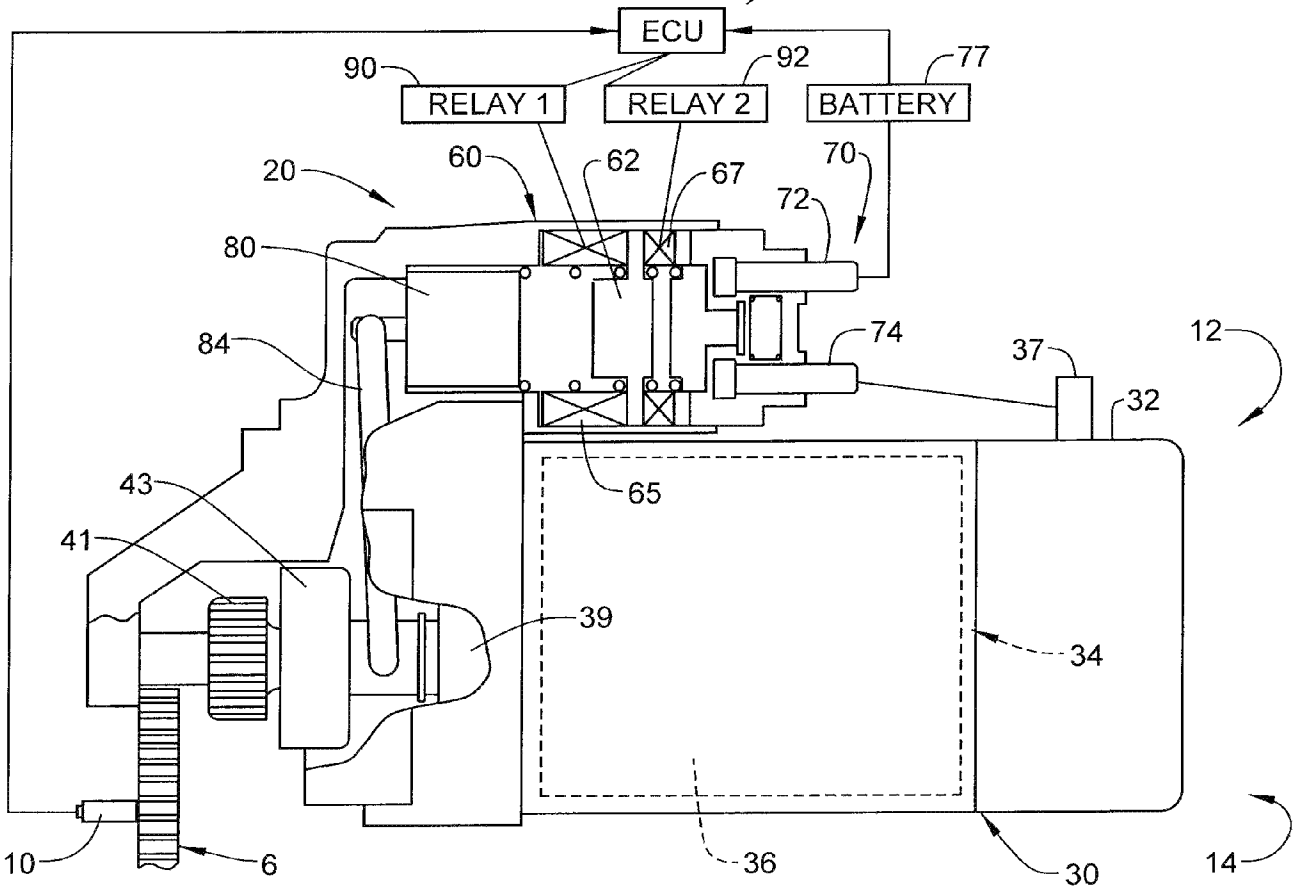
FIG. 2 depicts a partial cross-sectional side view of the COM starter of FIG. 1.

As shown in FIG. 2, COM starter motor 14 includes a housing 30 having an outer surface 32 that surrounds an interior portion 34. Interior portion 34 houses an armature 36. Armature 36 may be electrically connected to an armature terminal 37 which projects through housing 30 outwardly of outer surface 32. Armature 36 is supported by a shaft 39 that also supports a pinion 41 and a clutch assembly 43. Pinion 41 may be connected to armature 36 through a gear assembly (not shown).

Solenoid 20 is mounted to housing 30 of COM starter motor 14. Solenoid 20 includes a solenoid housing 60 surrounding an interior section 62. Interior section 62 houses a first coil 65 and a second coil 67. Solenoid 20 is also shown to include a plurality of terminals 70 including a first or battery terminal 72 and a second or armature terminal 74. Battery terminal 72 is electrically connected to an energy source such as a battery 77. Solenoid 20 is further shown to include a plunger 80 operatively associated with first coil 65. Plunger 80 selectively acts upon a lever 84 to axially shift pinion 41 into meshing engagement with ring gear 8. As will be detailed more fully below, ECU 24 activates a first relay 90 to energize first coil 65 to axially shift pinion 41 and a second relay 92 to energize second coil 67 closing a circuit (not separately labeled) allowing electrical current to flow from battery 77 to armature 36 causing pinion 41 to rotate.

As will be discussed more fully below, first coil 65 is energized when pinion 41 is rotating at a predetermined speed relative to ring gear 8. If ring gear 8 is stationary, first coil 65 may be energized before pinion 41 is rotating. If ring gear 8 is rotating, as sensed by sensor 10, second coil 67 is energized to begin rotating pinion 41. Only after pinion 41 reaches a predetermined speed, does ECU 24 energize first coil 65. In accordance with an exemplary embodiment, ECU 24 indirectly determines at what speed pinion 41 is rotating. The term "indirectly determines" should be understood to mean that ECU 24 determines pinion 41 speed without the use of a pinion speed sensor and without a sense wire to transmit an electrical signal from COM starter motor 14 to ECU 24. Instead, ECU 24 determines pinion speed by analyzing changes in an electrical parameter of battery 77. The change of electrical parameter may be a change in voltage, a change in current or combinations thereof The change of the electrical parameter may be measured at battery 77, at solenoid 20 or at armature 36.

Figure 3:
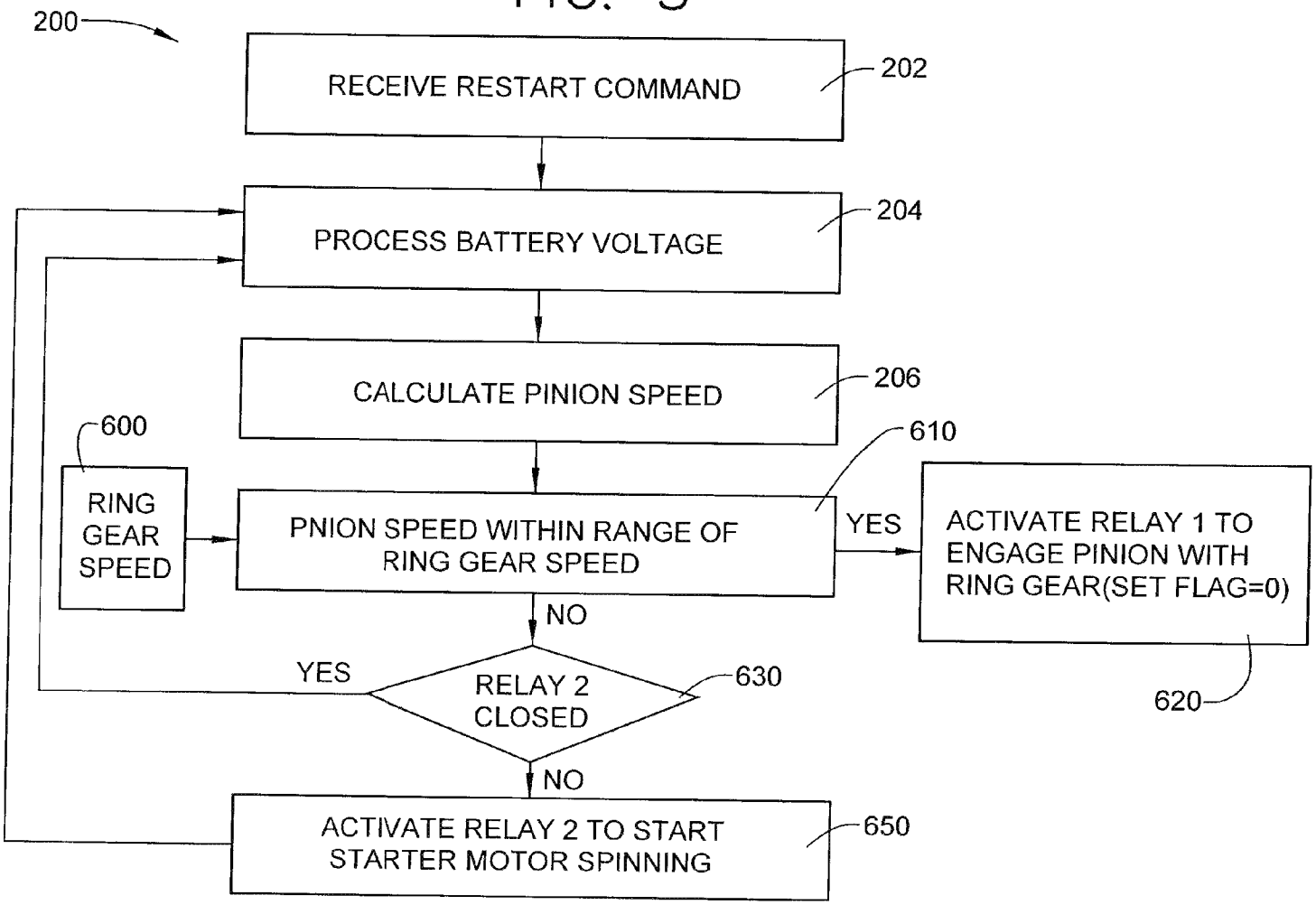
FIG. 3 depicts a flow chart illustrating a method of re-initiating operation of the internal combustion engine having a rotating ring gear, in accordance with an exemplary embodiment.
Figure 4:
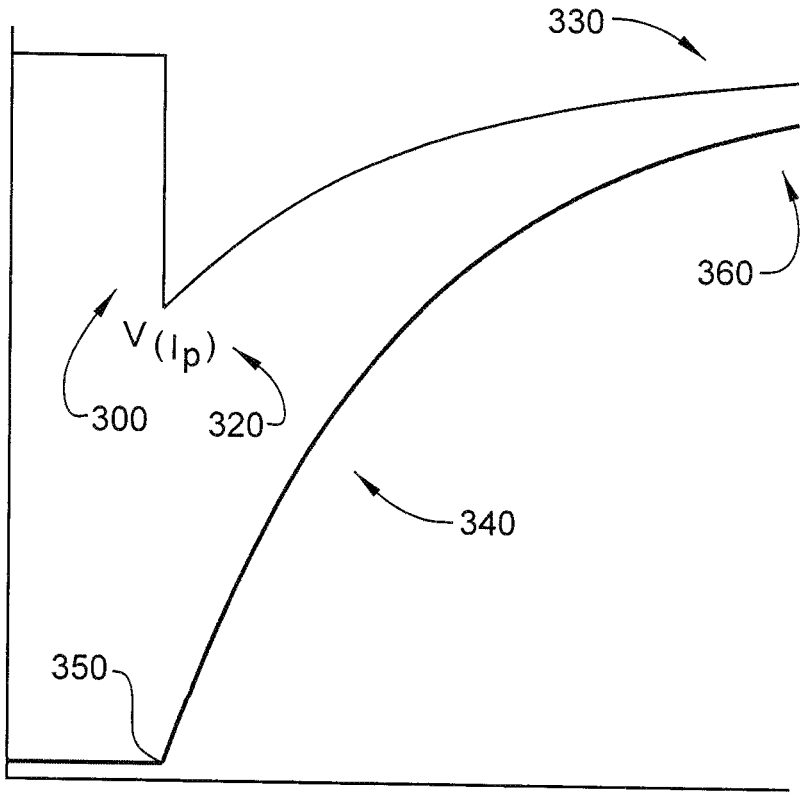
FIG. 4 depicts a graph illustrating a relationship between voltage and pinion speed, in accordance with an aspect of an exemplary embodiment.

FIG. 3 illustrates a method 200 of operating COM starter system 12. Initially, a restart command is received in block 202. After receiving a restart command, ECU 24 analyzes an electrical parameter of battery 77 in block 204. Based on a change in the electrical parameter, ECU 24 determines pinion speed in block 206. For example as shown in FIG. 4, battery voltage graph 300 drops to a low point V(lp) 320 upon activation of armature 36. Voltage graph 300 increases, over time, from low point 320 to a steady state 330. At the same time, a pinion speed 340 graph begins from a stationary point 350 that substantially coincides with low point 320 and gradually increases, over time, to a steady state 360. By analyzing a change in voltage graph 300, ECU 24 may determine pinion speed at any time between low point 320 to steady state 330.

ECU 24 may determine a speed of armature 36 by measuring a voltage V(n) and comparing the value V(n) to a previously measured voltage V(n−1). ECU stores the lower of value V(n) and V(n−1) in V(0). V(0) will eventually be equal to low point V(lp) 320 of battery voltage (300). Of course, other methods may be used to determine the low point 320. ECU 24 determines a speed S(a) of armature 36 by measuring battery voltage (300). Speed S(a) of armature 36 may be determined by the formula $$S(a)=\{[V(n)-V(lp)]*K1\}+K10$$

where K1 and K10 are constants.

K1 and K10 may be determined empirically

This equation for S(a) above may be a linear equation or a first order polynomial equation. It should of course be understood that a second order polynomial, third order polynomial or any order polynomial equation may also be used. It should also be understood that constant K10 may be equal to zero.

ECU 24 may calculate a speed S(p1) of pinion 41 based on $$S(p1)=S(a)*K2$$

where K2 equals a constant equal to a gear ratio between pinion 41 and armature 36.

A gear (not shown), that establishes the gear ratio, between pinion 41 and armature 36 is well known in the art and is typically a planetary or offset gear system. ECU 24 may then convert the speed S(p1) of pinion 41 to a pinion speed S(p) that is considered correlated to the engine speed based on $$S(p)=S(p1)*K4$$

where K4 is a constant equal to the gear ratio between ring gear 8 and pinion 41.

Figure 5:
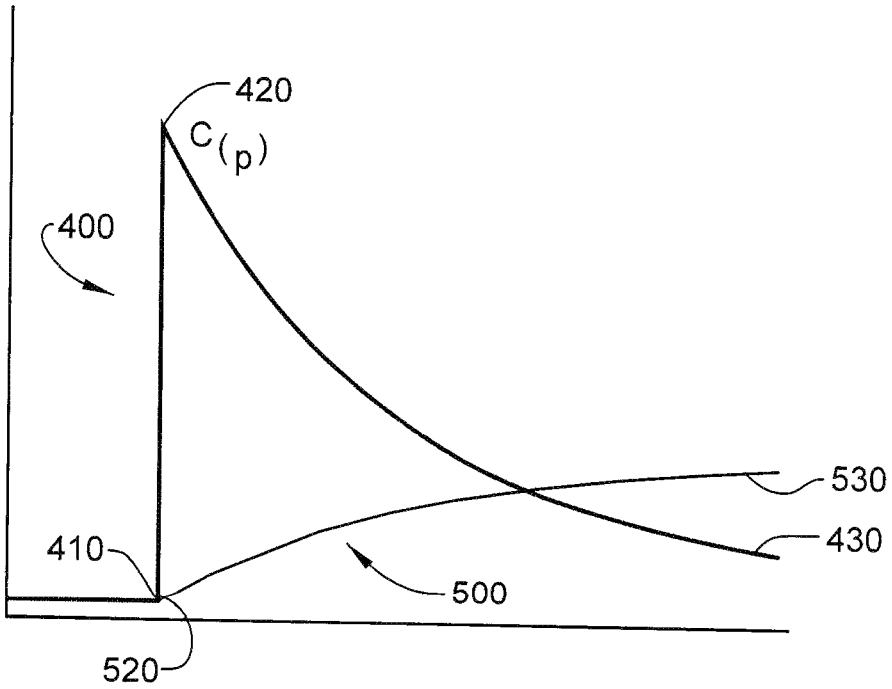
FIG. 5 depicts a graph illustrating a relationship between current and pinion speed, in accordance with another aspect of an exemplary embodiment.

Similarly, a current graph 400, shown in FIG. 5, substantially, instantaneously, increases from a zero point 410 to a peak C(p) 420 upon activation of second coil 67. Current gradually subsides, over time, to a steady state 430. At the same time, a speed graph 500 increases from a zero point 520 to a steady state 530. By analyzing a change in current, ECU 24 may determine pinion speed for any given time between zero point 410 and steady state 430. ECU 24 may determine speed S(a) of armature 36 by measuring current C(n) and comparing current C(n) to a previously measured current C(n−1). ECU 24 stores a higher of value C(n) and C(n−1) in C(0). C(0) will eventually be equal to peak 420 [or C(p)] of the current (400). Of course, other methods may be used to determine peak 420. Speed S(a) of armature 36 may be determined by measuring battery current (400) and calculating the speed S(a) of the armature 36 in ECU 24 based on $$S(a)=\{[C(p)-C(n)]*K3\}+K11$$

where K3 and K11 are constants

K3 and K11 may be determined empirically

ECU 24 calculates speed S(p) of pinion 41 based on $$S(p)=S(a)*K2$$

where K2 equals a constant equal to the gear ratio between the pinion 41 and the armature 36. This equation for S(a) above may be a linear equation or a first order polynomial equation. Of course, it should be understood, that a second order polynomial, third order polynomial or any order polynomial equation may also be used. It should also be understood that constant K11 may be equal to zero.

ECU 24 converts speed S(p1) of pinion 41 to a pinion speed S(p) that is considered correlated to the engine speed by the equation:

$$S(p)=S(p1)*K4$$

where K4 is a constant equal to the gear ratio between ring gear 8 and the pinion 41.

After determining pinion speed in block 206, ECU 24 receives data from speed senor 10 regarding ring gear speed in block 600. At this point, ECU 24 determines, in block 610, whether pinion 41 is rotating within a predetermined speed range relative to ring gear 8. If pinion 41 and ring gear 8 are generally synchronized, first relay 90 energizes first coil 65 in block 620. When first coil 65 is energized, pinion 41 is axially shifted into meshing engagement with ring gear 8 to re-initiate operation of internal combustion engine 2. The term "generally synchronized" should be understood to mean that pinion 41 is rotating within the predetermined speed range relative to a speed of ring gear 8. If, in block 610, pinion 41 and ring gear 8 are not synchronized, ECU 24 determines whether second relay 92 has closed to energize second coil 67 in block 630. If second relay 92 is closed, method 200 returns to block 204. If, however, second relay 92 is open, a signal is sent to close second relay 92 in block 650 and method 200 returns to block 204.

At this point, it should be understood that the change of mind (COM) starter system, in accordance with an exemplary embodiment, determines whether the pinion and the ring gear are synchronized by indirectly determining pinion speed. More specifically, ECU determines pinion speed without the use of a pinion speed sensor. ECU determines pinion speed based on changes in electrical parameters of a vehicle battery connected to operate the COM starter motor. In this manner, the exemplary embodiments reduce the need for additional sensors, wiring, and connections as well as simplifies vehicle manufacturing and vehicle maintenance of and reduces the cost of replacement parts.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims.

What is claimed is:

1. An internal combustion engine comprising:
a ring gear;
a speed sensor operatively associated with the ring gear;
a change of mind (COM) starter motor mechanically linked to the internal combustion engine, the COM starter motor including an armature and a pinion operatively connected to the armature;
a solenoid operatively connected to the COM starter motor, the solenoid selectively moving the pinion into engagement with the ring gear, the solenoid including a first coil which, upon being energized, delivers an electrical current to the armature causing the pinion to rotate, and a second coil which, upon being energized, causes the pinion to be shifted into engagement with the ring gear; and
an electronic control unit (ECU) operatively connected to the speed sensor and the solenoid, the ECU being configured and disposed to indirectly detect a rotational speed of the pinion and selectively energize the solenoid to axially shift the pinion into engagement with the ring gear when the pinion reaches a particular rotational speed relative to a rotational speed of the ring gear, wherein the ECU detects a change in a battery voltage to determine the rotational speed of the pinion.

2. The internal combustion engine according to claim 1, wherein the ECU determines a low point [V(lp)] of the battery voltage.

3. The internal combustion engine according to claim 2, wherein the ECU measures the battery voltage V(n) and calculates a speed S(a) of the armature based on the values V(n) and V(lp).

4. The internal combustion engine according to claim 3, wherein the ECU measures the battery voltage V(n) and calculates a speed S(a) of the armature as S(a)={[V(n)−V(lp)]*K1}+K10 where K1 and K10 are constants.

5. The internal combustion engine according to claim 4, wherein the ECU calculates a speed S(p1) of the pinion from the formula S(p1)=S(a)*K2 where K2 equals a constant equal to the gear ratio between the pinion and the ring gear.

6. The internal combustion engine according to claim 2, further including a battery and wherein the ECU detects a change in the battery voltage at the battery, to determine the rotational speed of the pinion.

7. The internal combustion engine according to claim 1, wherein the ECU detects a change in a battery current to determine the rotational speed of the pinion.

8. The internal combustion engine according to claim 7, wherein the ECU determines a peak [C(p)] of the battery current.

9. The internal combustion engine according to claim 8, wherein the ECU measures a current C(n) and calculates a speed S(a) of the armature based on the values C(n) and C(p).

10. The internal combustion engine according to claim 9, wherein the ECU measures a current C(n) and calculates a speed S(a) of the armature as S(a)={[C(p)−C(n)]*K3}+K11 where K3 and K11 are constants.

11. The internal combustion engine according to claim 10, wherein the ECU calculates a speed S(p1) of the pinion from the formula S(p1)=S(a)*K2 where K2 equals a constant equal to the gear ratio between the pinion and the ring gear.

12. A change of mind (COM) starter motor comprising:
an armature;
a pinion operatively connected to the armature;
a solenoid operatively connected to the COM starter motor, the solenoid including a first coil which, upon being energized, delivers an electrical current to the armature causing the pinion to rotate, and a second coil which, upon being energized, causes the pinion to be axially shifted relative to the armature; and
an electronic control unit (ECU) operatively connected to the solenoid, the ECU being configured and disposed to indirectly detect a rotational speed of the pinion and selectively energize the solenoid to axially shift the pinion when the pinion reaches a particular rotational speed relative to a rotational speed of the ring gear, wherein the ECU detects a change in a battery voltage to determine the rotational speed of the pinion.

13. The COM starter motor according to claim 12, further comprising: a battery, wherein the ECU detects a change in the battery voltage at the battery to determine the rotational speed of the pinion.

14. A system comprising:
an armature;
a pinion operatively connected to the armature;
an energy source electrically coupled to the armature; and
an electronic control unit (ECU) electrically coupled to the energy source, the ECU being configured and disposed to indirectly detect a rotational speed of the pinion, wherein the ECU detects a parameter of an electrical signal passing from the energy source to the armature to determine the rotational speed of the pinion.

15. The system according to claim 14, wherein the parameter comprises a change in voltage of the energy source.

16. The system according to claim 14, wherein the the parameter comprises a change in current of the energy source.

17. An internal combustion engine comprising:
a ring gear;
a speed sensor operatively associated with the ring gear;
a change of mind (COM) starter motor mechanically linked to the internal combustion engine, the COM starter motor including an armature and a pinion operatively connected to the armature;

a solenoid operatively connected to the COM starter motor, the solenoid selectively moving the pinion into engagement with the ring gear, the solenoid including a first coil which, upon being energized, delivers an electrical current to the armature causing the pinion to rotate, and a second coil which, upon being energized, causes the pinion to be shifted into engagement with the ring gear; and an electronic control unit (ECU) operatively connected to the speed sensor and the solenoid, the ECU being configured and disposed to indirectly detect a rotational speed of the pinion and selectively energize the solenoid to axially shift the pinion into engagement with the ring gear when the pinion reaches a particular rotational speed relative to a rotational speed of the ring gear, wherein the ECU detects a change in battery current to determine the rotational speed of the pinion.

* * * * *